United States Patent [19]

Humphrey

[11] Patent Number: 4,674,597

[45] Date of Patent: Jun. 23, 1987

[54] TREE CLIMBING DEVICE

[76] Inventor: Denver L. Humphrey, 120 Dogwood Dr., Georgetown, Ky. 40324

[21] Appl. No.: 875,086

[22] Filed: Jun. 17, 1986

[51] Int. Cl.[4] ..... A63B 27/00

[52] U.S. Cl. ..... 182/92; 182/189; 248/231

[58] Field of Search ..... 182/92, 187, 100, 189, 182/188, 133-136; 248/231

[56] References Cited

U.S. PATENT DOCUMENTS

| | | | |
|---|---|---|---|
| 985,079 | 2/1911 | Venard | 248/231 |
| 1,133,511 | 3/1915 | Stutler | 248/330.1 |
| 1,163,444 | 12/1915 | Newell | 248/330.1 |
| 1,978,646 | 10/1934 | Oishei | 248/231 |
| 3,159,242 | 12/1964 | James | 182/92 |
| 3,420,503 | 1/1969 | Stangl | 182/235 |
| 3,520,383 | 7/1970 | Loock | 182/187 |
| 3,767,011 | 10/1973 | Witt | 182/187 |
| 4,422,527 | 12/1983 | Schultz | 182/92 |
| 4,600,081 | 7/1986 | Wade | 182/92 |

FOREIGN PATENT DOCUMENTS

| | | | |
|---|---|---|---|
| 1202857 | 1/1969 | France . | |
| 224286 | 1/1969 | Sweden . | |
| 1235356 | 6/1971 | United Kingdom | 248/231 |
| 369914 | 4/1973 | U.S.S.R. . | |

*Primary Examiner*—Reinaldo P. Machado
*Attorney, Agent, or Firm*—King & Schickli

[57] ABSTRACT

A portable apparatus for climbing a tree, pole or the like includes a housing with a tree engaging face and a step, a line carried on the housing, and a reel. The line is movable between a retracted position wherein the line is contained within the housing for storage and transport and an extended position wherein the line is attached to the housing on the tree for climbing. A distal end of the line includes a latching block. The latching block is received and retained within a latching slot in the housing after encircling the tree or pole with the line. A biasing spring connected to the reel mechanism assures the take-up of any slack in the line. Following the take-up of slack, a locking pin is moved along a guide track in the housing until it engages a locking slot in the reel. The pin and slot cooperate to maintain the reel in position, thereby positively preventing the paying out of line and allowing safe tree climbing by stepping on the device. After use, the locking pin is disengaged from the locking slot. The line is then payed out to provide slack for the removal of the latching block from the latching slot. The spring biased reel then retracts the cable into the housing for simple, trouble-free convenient handling.

16 Claims, 5 Drawing Figures

TREE CLIMBING DEVICE

BACKGROUND OF THE INVENTION

The present invention relates generally to the art of climbing and, more particularly, to an apparatus for climbing trees, utility poles or the like that is simple and more convenient to handle while also providing improved climber safety during use.

For reasons of safety and to avoid potential liability from accidents, utility pole footholds for maintenance personnel typically start some 10 to 12 feet above the ground. This approach is designed to discourage and prevent unauthorized people from climbing up the poles. Of course, utility maintenance personnel need safe and effective climbing aids to reach these footholds in order to make repairs as required; for example, to correct power outages following severe thunderstorms.

Game hunters of, for example, deer often position themselves in tree stands in trees overlying paths followed by the game through the woods. Mature trees in a forested area do not include branches down near the ground so as to allow climbing. As such, hunters have a need for climbing aids that will allow them to get up in a tree along the trunk far enough to reach the lower lying limbs often some 10 to 15 feet above the ground.

Recognizing these needs a number of devices have been developed in the art for climbing utility poles and trees. Examples of such devices are found in Russian Pat. No. 369,914 and Swedish Pat. No. 224,286.

The Russian patent discloses a linesman climbing device including a chain that is extended around the utility pole to be climbed and a complicated conical gear arrangement for automatically controlling the slack in the chain as the weight of the linesman is applied. The Swedish patent discloses a pole climbing device including a band that is extended around the pole. A gear including a series of lugs that extend through apertures in the band is mounted to the housing to tighten and secure the band in position around the poles for climbing.

While these two devices are effective climbing aids, they are not without their disadvantages and could, therefore, be improved. Where an individual is required to climb some 10 to 15 vertical feet before reaching a foothold or tree limb, some 7 or 8 of the climbing aids of the type described above may be required to be used in series along the pole or tree trunk. When not in use, the Russian and Swedish devices are not compact since both include extended lengths of chains and bands, respectively, that are free to become twisted and tangled around each other and other objects during storage and transport to the climbing site. The chains or bands could also become separated and lost from the device leaving the device useless for its intended climbing purpose.

SUMMARY OF THE INVENTION

Accordingly, it is a primary object of the present invention to provide an improved pole and/or tree climbing apparatus that is compact and less cumbersome than those available in the prior art.

Another object of the present invention is to provide a climbing apparatus allowing easy and trouble-free use while substantially eliminating any damage to the tree being climbed.

A further object of the present invention is to provide a tree and/or pole climbing apparatus that positively locks in position to securely engage the tree or pole being climbed thereby improving overall safety.

Additional objects, advantages, and other novel features of the invention will be set forth in part in the description that follows and in part will become apparent to those skilled in the art upon examination of the following or may be learned with the practice of the invention. The objects and advantages of the invention may be realized and attained by means of the instrumentalities and combinations particularly pointed out in the appended claims.

To achieve the foregoing and other objects, and in accordance with the purposes of the present invention as described herein, an improved apparatus is provided for climbing a tree, pole or the like. The apparatus includes a housing, a line carried on the housing and a means, such as a reel, for paying out the line between a retracted position for storage and transport, and an extended position wherein the line is used to attach the climbing apparatus to the tree or pole.

Preferably, the distal end of the line includes a latching block. A latching slot is provided in the housing for receiving and retaining this latching block. Specifically, the extended line is positioned around the tree to be climbed and the latching block is positioned within the latching slot in order to attach the apparatus to the tree.

A spring provided in cooperation with the reel biases the line toward the retracted position wherein the line is retained within the housing. Thus, the spring biased reel takes up any slack in the line encircling the tree to be climbed. The smooth take up of slack is further assured by a line guide bushing of low friction material provided in the opening in the housing through which the line is paid from the reel.

Positive and secure attachment of the apparatus to the tree with assurance of improved safety is provided through the provision of a locking mechanism. The locking mechanism includes a locking pin that slides within a guide track in the housing. The locking pin may be selectively positioned to be received within a locking groove in the reel so as to positively retain the reel in a selected position and prevent any paying of the line during climbing.

Preferably, a spring is provided to maintain the locking pin in the locked position within the locking groove with positive biasing action.

Additional safety features of the present invention include the provision of a non-skid surface on an enlarged flat step for the climber on the top of the housing. The housing also includes a tree engaging face for stability. This face prevents the apparatus from shifting and/or twisting on the tree and throwing the climber.

Advantageously, the improved safety and positive retention of the climbing apparatus to the tree or pole to be climbed is provided without damage to the tree or pole. This is possible through the provision of the enlarged engaging face on the housing and the use of the line, such as a cable, with relatively smooth sides that do not tend to gouge or dig into the tree bark. As such, the device is perfectly appropriate for use in national and state parks and forests and other areas where hunting may be allowed but damage to trees is prohibited.

Still other objects of the present invention will become readily apparent to those skilled in this art from the following description wherein there is shown and described a preferred embodiment of this invention, simply by way of illustration of one of the modes best suited to carry out the invention. As it will be realized, the invention is capable of other different embodiments, and its several details are capable of modifications in various, obvious aspects all without departing from the invention. Accordingly, the drawing and descriptions will be regarded as illustrative in nature and not as restrictive.

BRIEF DESCRIPTION OF THE DRAWING

The accompanying drawing incorporated in and forming a part of this specification, illustrates several aspects of the present invention, and together with the description serves to explain the principles of the invention. In the drawing.

Reference will now be made in detail to the present preferred embodiment of the invention, an example of which is illustrated in the accompanying drawing.

DETAILED DESCRIPTION OF THE INVENTION

Figure 1:
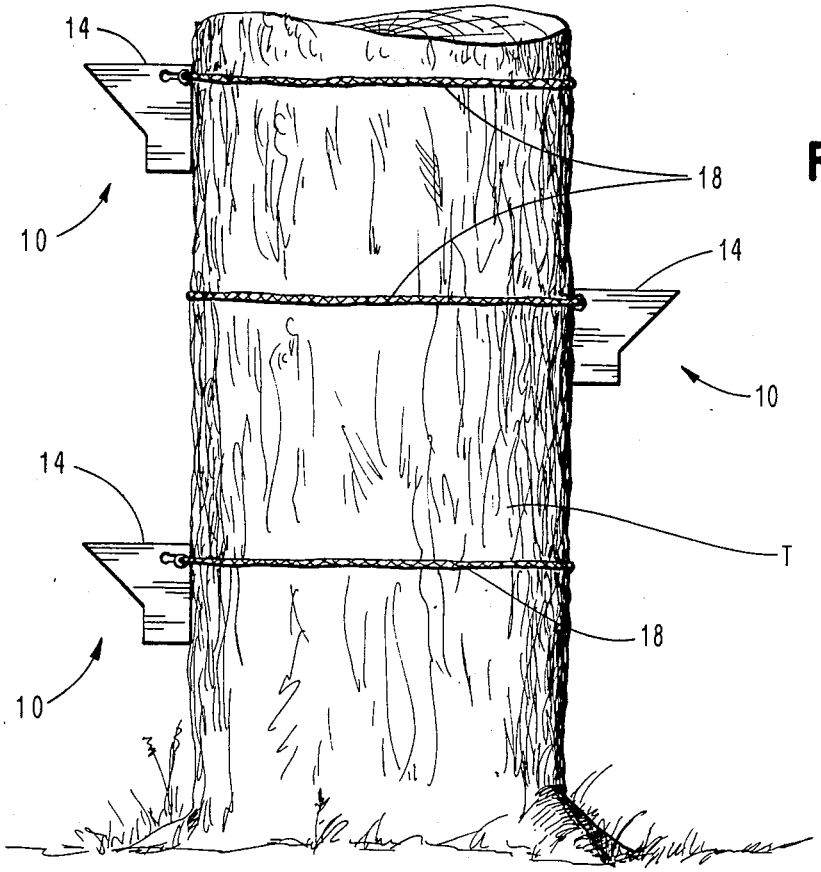
FIG. 1 is a cut-away side elevational view showing several apparatus of the present invention positioned in series for climbing the trunk of a tree in order to reach the lower lying limbs (not shown) well above ground level.
Figure 2:
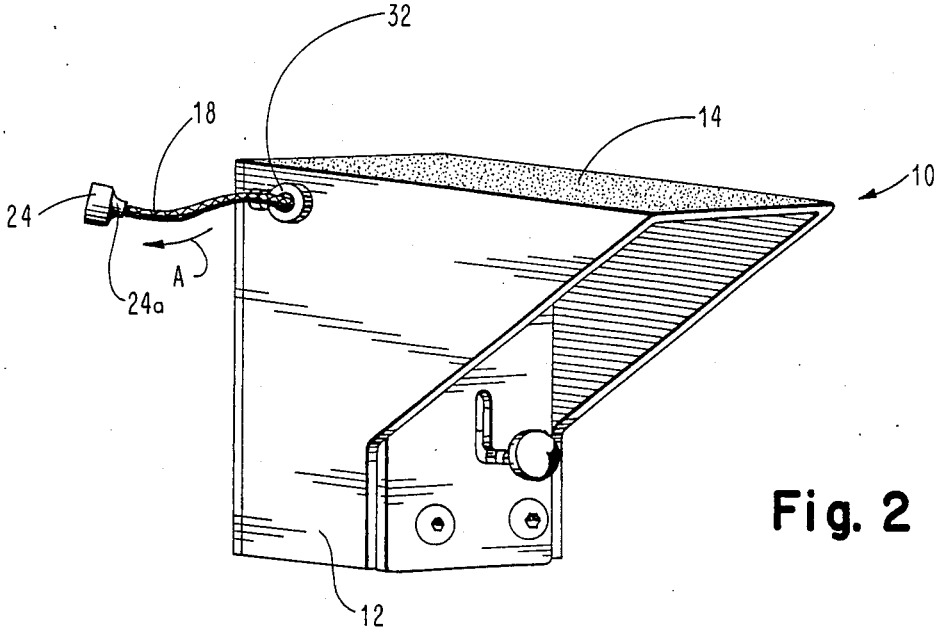
FIG. 2 is a perspective view of one of the climbing apparatus of the present invention.
Figure 3:
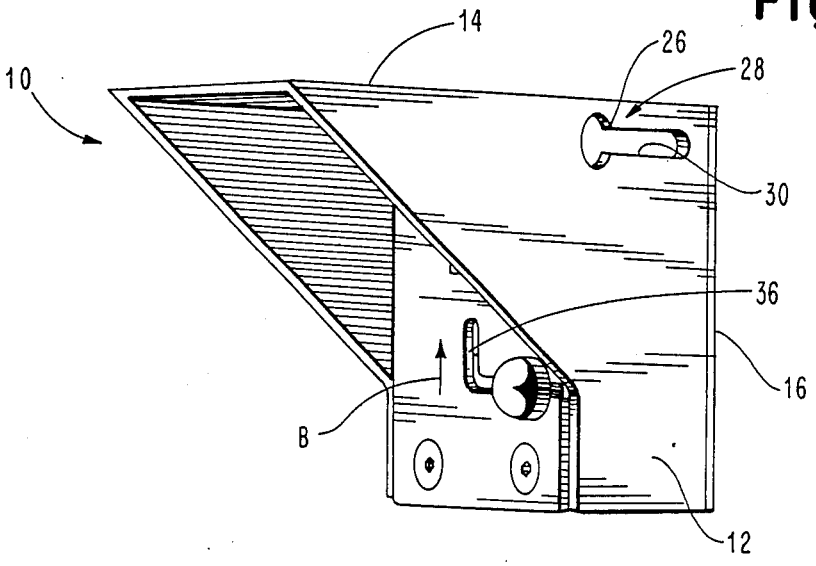
FIG. 3 is an opposite perspective view of the same climbing device shown in FIG. 2.

Reference is now made to FIGS. 1–3 showing the improved climbing apparatus 10 of the present invention for climbing trees T, poles or the like. As shown, the apparatus 10 includes a housing 12 having a step 14 with a non-skid surface and a tree engaging face 16 for added stability during climbing.

Figure 4:
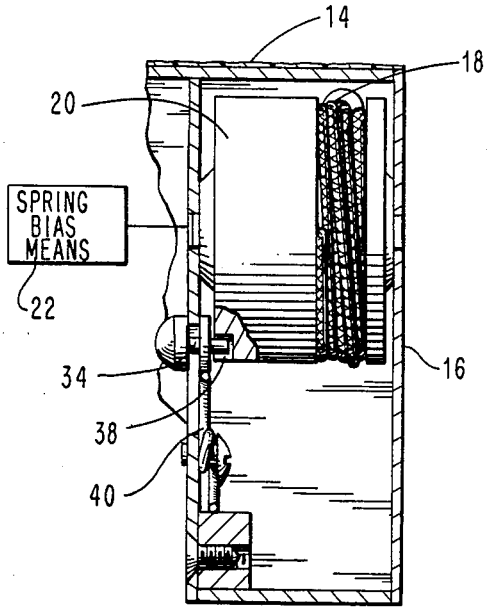
FIG. 4 is a cross-sectional view of the climbing device of the present invention showing the reel in the locked position.
Figure 5:
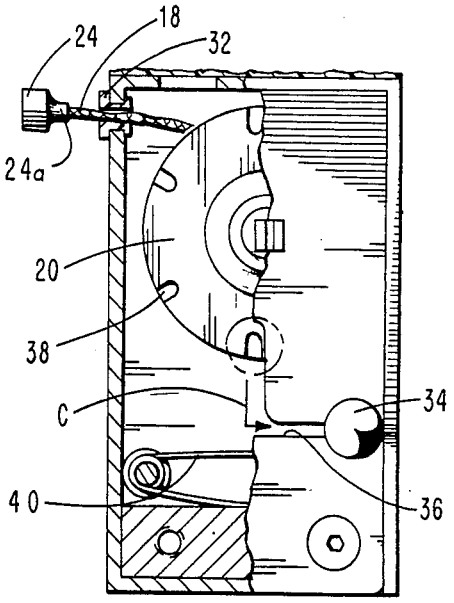
FIG. 5 is a partial cross-sectional view of the device shown in FIG. 4 with the reel in the unlocked position.

A line in the form of a cable 18 is wound to a reel 20 carried on the housing 12 (note FIGS. 4 and 5). As shown schematically in FIG. 4, the reel 20 is biased by a flat coil spring 22, similar to a mechanical watch mainspring as is known in the art, to maintain the cable 18 in a retracted position within the housing (note FIGS. 2 and 3). A latching block 24 at the distal end of the cable 18 ensures that the retracted cable may be engaged outside the housing by the fingers of the operator in order to position the device for climbing, as described below.

In order to climb a tree utilizing the device 10, the operator engages the latching block 24 with his fingers and pulls in the direction of action arrow A (note FIG. 2) to unwind the cable 18 from the reel 20 and extend the cable from the housing 12. The extended cable 18 is then positioned to encircle the tree T to be climbed (note FIG. 1). With the tree engaging face 16 of the housing 12 positioned toward the tree T, some slack is pulled in the cable and the latching block 24 is then pushed through the circular portion 26 of the latching slot 28 in the housing 12 (see FIG. 3). As the spring loaded reel 20 advantageously takes up the slack in the cable 18, the neck 24*a* of the latching block 24 slides into the narrowed groove 30 of the latching slot 28. This arrangement provides secure, slip-free engagement of the cable 18 with the housing 12. Smooth slack take-up is assured by the provision of a low friction cable guide bushing 32 in the opening in the housing 12 through which the cable 18 is extended.

Following the complete take-up of slack, the locking mechanism is activated for maximum climbing safety. Specifically, the locking pin 34 is engaged and moved along the guide track 36 in the housing 12 (note action arrow B in FIG. 3) so that the end of the pin extends into one of a series of locking grooves 38 in the reel 20. A spring 40 biases the locking pin 34 to positively maintain the pin in the locked position.

It should be appreciated that by engaging the reel 20 with the locking pin 34, the reel is positively locked in position and no cable 18 may thereafter be payed out therefrom. As such, a possible cause of slipping down along the tree T during climbing is eliminated and safety is greatly improved.

By positioning a series of climbing apparatus 10 in series along a tree trunk as shown in FIG. 1, the user is able to reach lower lying branches of a tree any number of feet above ground. This is done by simply using the non-skid steps 14 as a foothold in a manner similar to a ladder. The tree engaging face 16 advantageously prevents any twisting of the apparatus 10 during climbing as weight is applied to the step 14. Further, the smooth tree engaging cable 18 prevents damage to the tree T during use.

After use, the apparatus 10 may be easily removed from the tree T. Locking pin 34 is moved along the guide track 36 in the direction of action arrow C in FIG. 5 from the locked position (shown in dash line) to the unlocked position (shown in full line). Some additional cable 18 is then payed out from the reel 20 to provide the slack necessary to slide the latching block 24 from the latching slot 28. The spring loaded reel 20 then serves to wind the cable 18 to the retracted position within the housing 12.

Since there is no free cable 18 to become twisted and wrapped around other objects, handling of the apparatus of the present invention is greatly simplified. Further, because of the shape of the apparatus, a number of the devices can be nested together and conveniently carried within a minimum of space in a backpack or the like.

In summary, numerous benefits have been described which result from employing the concepts of the present invention. Improved climber safety is provided through the provision of a climbing apparatus 10 including a spring biased reel 20 that automatically takes up slack in the cable 18 encircling the tree T and a locking mechanism 34, 36, 38 and 40 to lock the reel in position. Any damage to the tree being climbed is substantially eliminated through the provision of an apparatus including a relatively large engaging face 16 and a smooth cable that encircles and positively engages the tree without gouging into the bark. Handling convenience is also greatly improved with the cable being contained completely within the housing when the apparatus is not in use.

The foregoing description of a preferred embodiment of the invention has been presented for purposes of illustration and description. It is not intended to be exhaustive or to limit the invention to the precise form disclosed. Obvious modifications or variations are possible in light of the above teachings. The embodiment was chosen and described to provide the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally and equitably entitled.

I claim:

1. An apparatus for climbing a tree, pole or the like without causing damage thereto, comprising:

a housing;

line means carried on said housing;

means for paying out said line means between a retracted position for storage and transport, and an extended position wherein said line means is used to attach said apparatus to the tree for climbing;

means for locking said paying means in position, said locking means including a locking pin and a locking groove in said paying means for receiving said locking pin; and a guide track in said housing for said locking pin, said locking pin extending through said guide track so as to be exposed for easy, trouble-free activation and selective positioning of said locking pin.

2. The climbing apparatus set forth in claim 1, wherein said line means includes a latching means connected to a distal end of said line means.

3. The climbing apparatus set forth in claim 2, wherein a latching slot is provided in said housing for receiving and retaining said latching means when said line means is in said extended climbing position.

4. The climbing apparatus set forth in claim 3, wherein said latching means is in the form of a block including a reduced neck portion for sliding, secure engagement within a narrowed groove of said latching slot.

5. The climbing apparatus set forth in claim 4, wherein an opening through which said line means is payed out is provided in said housing opposite said latching slot.

6. The climbing apparatus set forth in claim 5, wherein a line guide bushing of low friction material is provided in said opening for easy, smooth line feeding action.

7. The climbing apparatus set forth in claim 1, wherein said paying means includes a reel.

8. The climbing apparatus set forth in claim 7, wherein means is provided in cooperation with said reel for biasing said line means toward said retracted position within said housing.

9. The climbing apparatus set forth in claim 8, wherein said biasing means is a spring.

10. The climbing apparatus set forth in claim 1, wherein a step is provided on said housing.

11. The climbing apparatus set forth in claim 10, wherein said step includes a non-skid surface.

12. The climbing apparatus set forth in claim 1, wherein said housing includes a tree engaging face for stability.

13. The climbing apparatus set forth in claim 12, wherein said tree engaging face is enlarged to prevent twisting of said apparatus and gouging of said tree during climbing and said line means is a smooth cable so as to prevent damage to the tree during use.

14. An apparatus for climbing a tree, pole or the like without causing damage thereto, comprising:

a housing;

line means carried on said housing;

means for paying out said line means between a retracted position for storage and transport, and an extended position wherein said line means is used to attach said apparatus to the tree for climbing;

means for locking said paying means in position, said locking means including a locking pin and a locking groove in said paying means for receiving said locking pin; and a guide track in said housing for said locking pin, said locking pin extending through said guide track so as to be exposed for easy, trouble-free activation and selective positioning of ssid locking pin;

said climbing apparatus further including means for selectively and positively retaining said locking pin in a locked position within said locking groove and in an unlocked position free of said locking groove.

15. The climbing apparatus set forth in claim 14, wherein said retaining means is a spring engaging said locking pin and mounted to said housing.

16. An apparatus for climbing a tree, pole or the like without causing damage thereto, comprising:

a housing including a latching slot, a step for supporting a climber, and an enlarged tree engaging face to prevent twisting of said apparatus and gouging of said tree during climbing:

line means carried on said housing, said line means being provided in the form of smooth cable so as to prevent damage to the tree during use, said cable including a latching means connected to a distal end;

means in the form of a reel for paying out said cable between a retracted position for storage and transport and an extended position wherein said cable is used to attach said apparatus to the tree for climbing, said cable extending around said tree with said latching means securely received in said latching slot;

means provided in cooperation with said reel for biasing said cable toward said retracted position within said housing;

means for locking said reel in position, said locking means including a locking pin and a locking groove in said paying means for receiving said locking pin;

a guide track in said housing for said locking pin, said locking pin extending through said guide track so as to be exposed for easy, trouble-free activation and selective positioning of said locking pin; and means for selectively and positively retaining said locking pin in a locked position within said locking groove and in an unlocked position free of said locking groove.

* * * * *